United States Patent [19]

Waas

[11] 3,973,509

[45] Aug. 10, 1976

[54] ICEBREAKER VESSEL

[76] Inventor: Heinrich Waas, Bramfelder Strasse 164, 2 Hamburg 33, Germany

[22] Filed: July 15, 1974

[21] Appl. No.: 488,709

[30] Foreign Application Priority Data

Aug. 20, 1973 Germany ..... 2341932
June 8, 1974 Germany ..... 2427695

[52] U.S. Cl. ..... 114/42
[51] Int. Cl.[2] ..... B63B 35/08
[58] Field of Search ..... 114/40, 41, 42; 299/24, 299/27

[56] References Cited

UNITED STATES PATENTS

| | | | |
|---|---|---|---|
| 17,209 | 5/1857 | Estlack | 114/41 |
| 449,517 | 3/1891 | Bodenstein | 299/24 |
| 3,636,904 | 1/1972 | Blanchet | 114/41 |
| 3,648,635 | 3/1972 | Hashemi | 114/40 |
| 3,658,024 | 4/1972 | Stoffel | 114/40 |
| 3,693,360 | 9/1972 | Holder | 114/40 |

*Primary Examiner*—Trygve M. Blix
*Assistant Examiner*—Gregory W. O'Connor
*Attorney, Agent, or Firm*—Toren, McGeady and Stanger

[57] ABSTRACT

An icebreaker having a cantilever forecastle from which is suspended one sliding carriage or a plurality of sliding carriages. Each sliding carriage mounts one planing tool or a plurality of planing tools with increasing depth of cut, in a tandem arrangement. The suspension means for each sliding carriage may consist of a linkage or of cables or booms. The one or several sliding carriages are yieldingly suspended and may be withdrawn into the ship's hull. The ice cutting operation may be assisted by vibrating the sliding carriage or supplying heat and/or pressurized water to the planing tools.

12 Claims, 5 Drawing Figures

ICEBREAKER VESSEL

Figure 1:
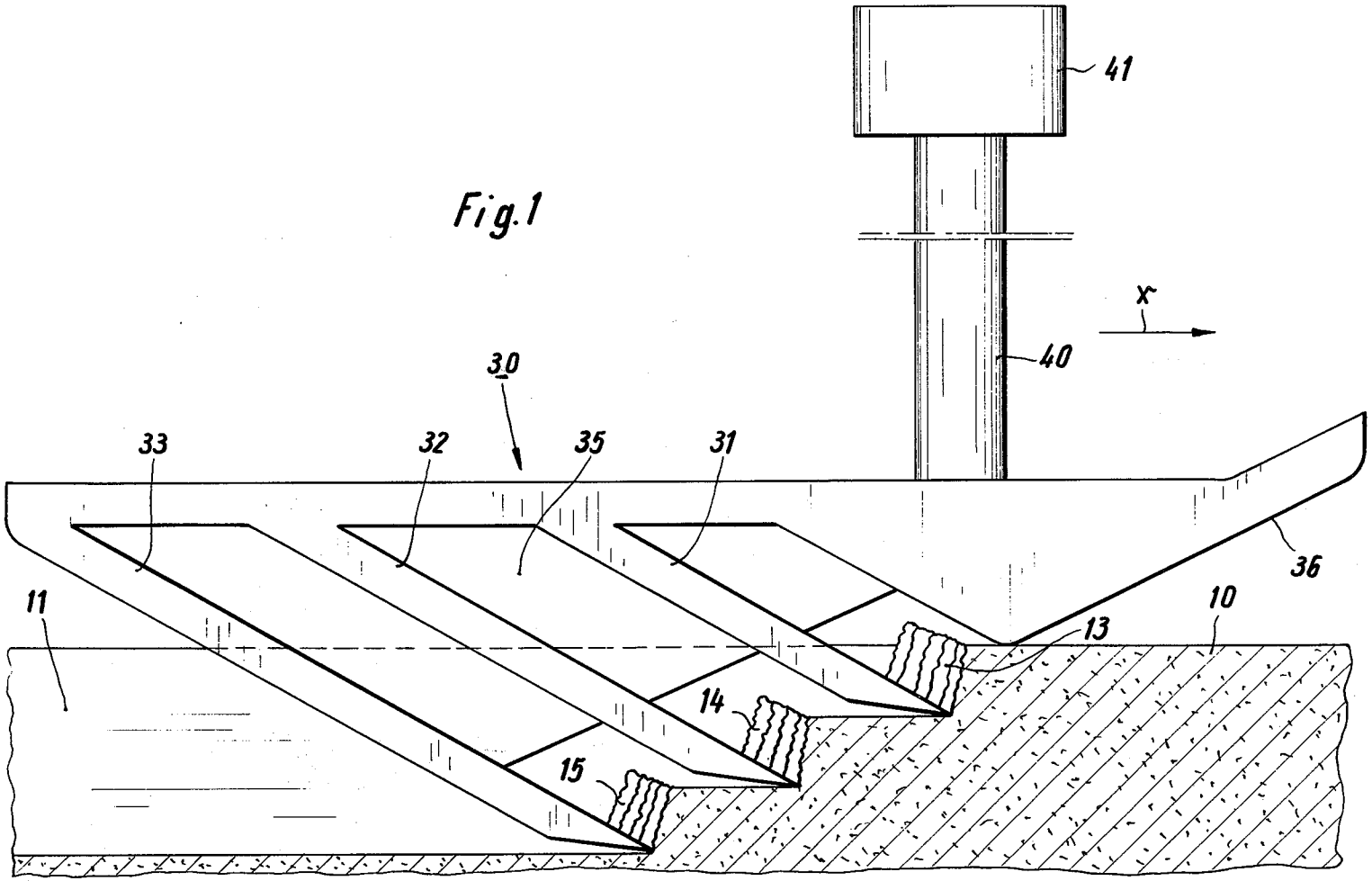

When icebreaker vessels have to make their way through thick ice sheets, high propulsive outputs are required, and such high propulsive outputs considerably lower the economy of operation of such vessels. Therefore it has already been proposed to improve upon the efficiency of the propulsive output by ship mounted booms carrying tools for cutting grooves into the ice sheets so that the ice may be broken more easily or even broken up entirely. The tools that may be employed for this purpose are similar to those used in timberwork. A drawback of heretofore proposed devices of this type, is, however, that the tools together with the necessary mechanical drive means for the tools are rather complicated and therefore potentially liable to failure thus rendering the tools unsuitable to withstand the severe wear and tear exerted thereon by the ice in combination with the marine operation of the ship. Failures are more likely to occur when the tools are intended to cut deeply into the ice of thick ice sheets.

It is therefore the object of the present invention to provide a novel and improved ice breaker vessel having apparatus for cutting grooves into ice wherein the overall operation of the icebreaker is improved and the drawbacks of heretofore known apparatus are avoided.

In accordance with the present invention, there is now proposed an icebreaker vessel comprising a ship's hull and marine propulsion means and characterized in that the forecastle of the ship's hull projects in the form of a cantilever above the ice and mounts a sliding carriage, and to the sliding carriage is secured at least one planing tool including an acute angle with the surface of the ice.

The present invention furthermore provides an icebreaker vessel comprising a ship's hull and marine propulsion means and characterized in that the forecastle of the ship's hull projects in the form of a cantilever above the ice and mounts a sliding carriage, and to the sliding carriage are secured a plurality of planing tools, each planing tool including an acute angle with the surface of the ice, the planing tools being arranged one behind the other in the direction of advancement of the ship in a step-like arrangement wherein the cutting edges of the planing tools lie in different horizontal planes and the lowermost plane is at the end facing the ship, and the planing tools are rigidly interconnected by a vertical plate-shaped mounting, the mounting being of a smaller width than each of the planing tools.

The sliding carriage is adapted to be lowered onto the surface of an ice sheet and is of a greater width than each of the planing tools, and carries at its front end a deflector surface coplanar with the planing tools and arranged at the upstream side thereof, and the planing tools are of different lengths.

For increasing the efficiency of the planing tools, the sliding carriage is coupled to a vibrating device for generating small amplitude high frequency vertical vibrations. Moreover, the planing tools may be provided with heat generating and/or heat transmitting means.

In accordance with a further embodiment of the present invention, a pressurized water pipe may include one or a plurality of downwardly and/or rearwardly directed discharge orifices arranged at a lower end portion of one planing tool or at lower end portions of all of the planing tools.

The icebreaker vessel may also be arranged in a manner allowing to withdraw the sliding carriage with the planing tools into the ship's hull when the icebreaker vessel is travelling in open seas. To this end, a stearing gear assembly such as a parallelogram type linkage or the like may be provided. In accordance with another characteristic of the present invention, the sliding carriage together with the planing tools is elastically suspended from the ship's hull. The height at which is suspended the cutting assembly consisting of sliding carriage and planing tools may be controlled, and likewise the yielding properties of the suspension.

The invention furthermore pertains to an apparatus for elastically suspending the sliding carriage, this apparatus including a first supporting arm rotatably mounted about the longitudinal axis of the supporting arm, the first supporting arm being arranged at the free end of a boom and extending in a direction parallel to the boom; an arcuately shaped guide portion arranged at the free end of the boom; a crown piece arranged at the free end of the first supporting arm and adapted to be rotated about the arcuately shaped guide portion and about a horizontal swivel axis by a motive means; and a substantially vertical second supporting arm mounted on the crown piece and supporting the sliding carriage at a free lower end, the second supporting arm rotatably mounted about the vertical longitudinal axis of the supporting arm.

Figure 2:
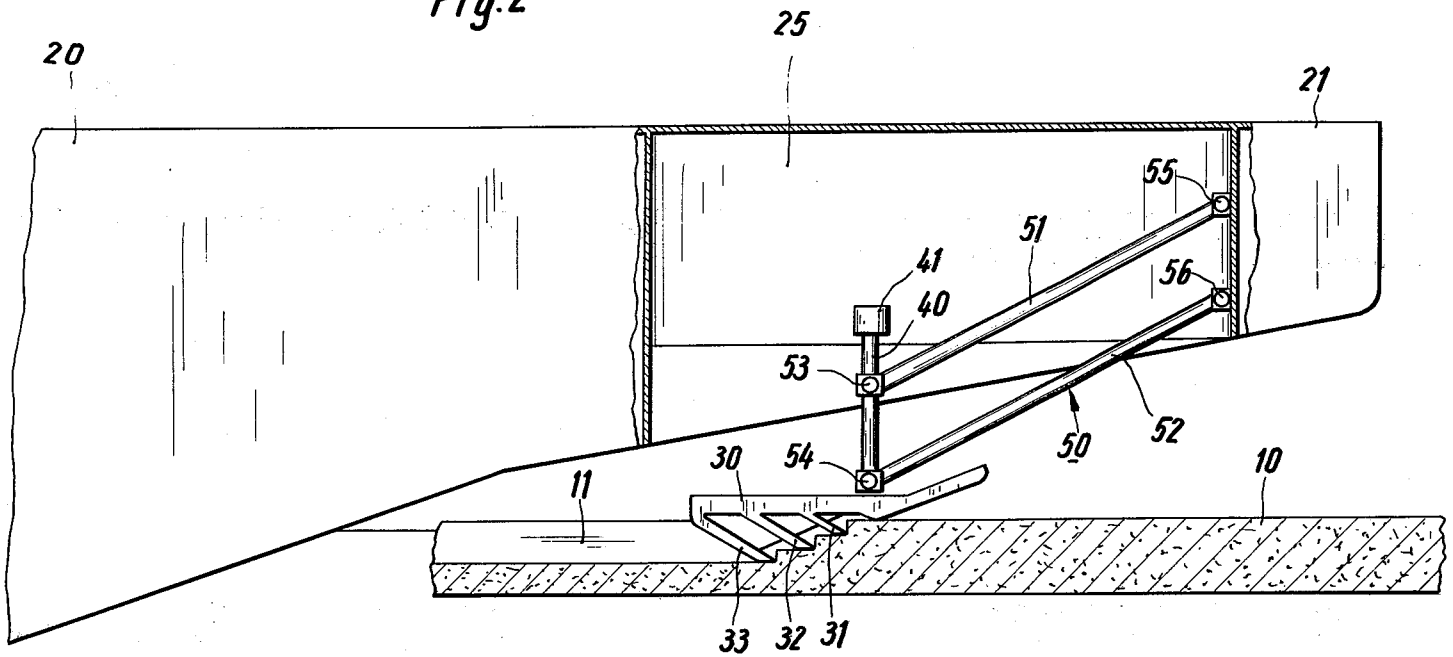
Figure 3:
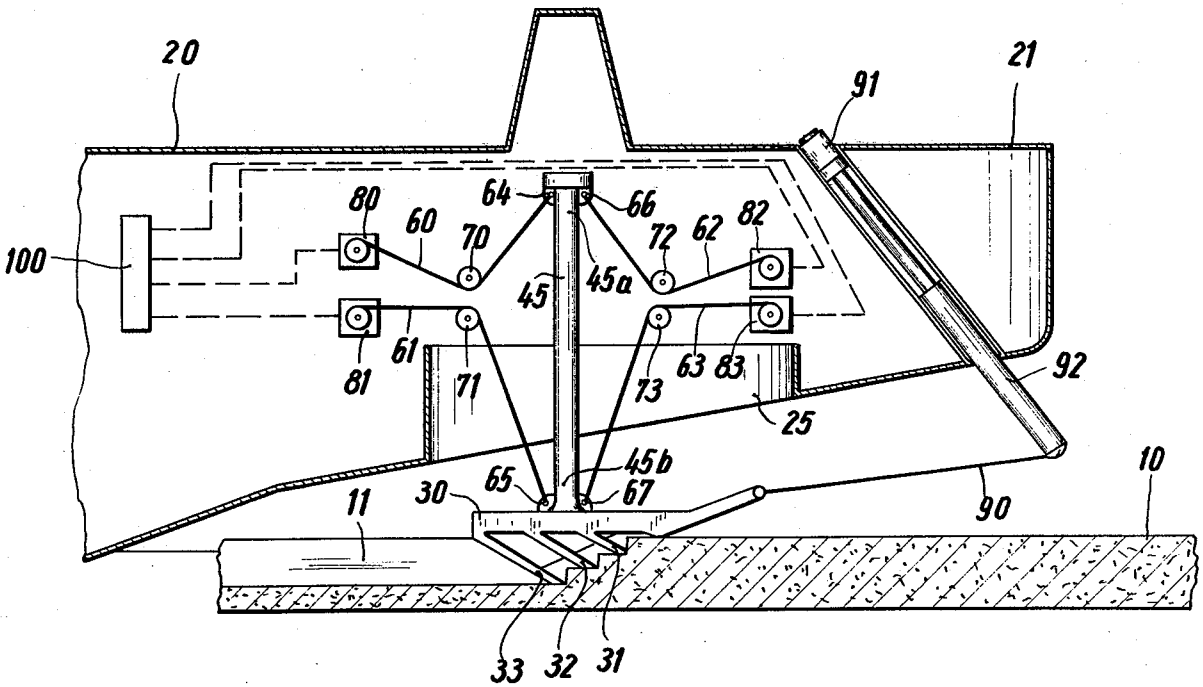
Figure 4:
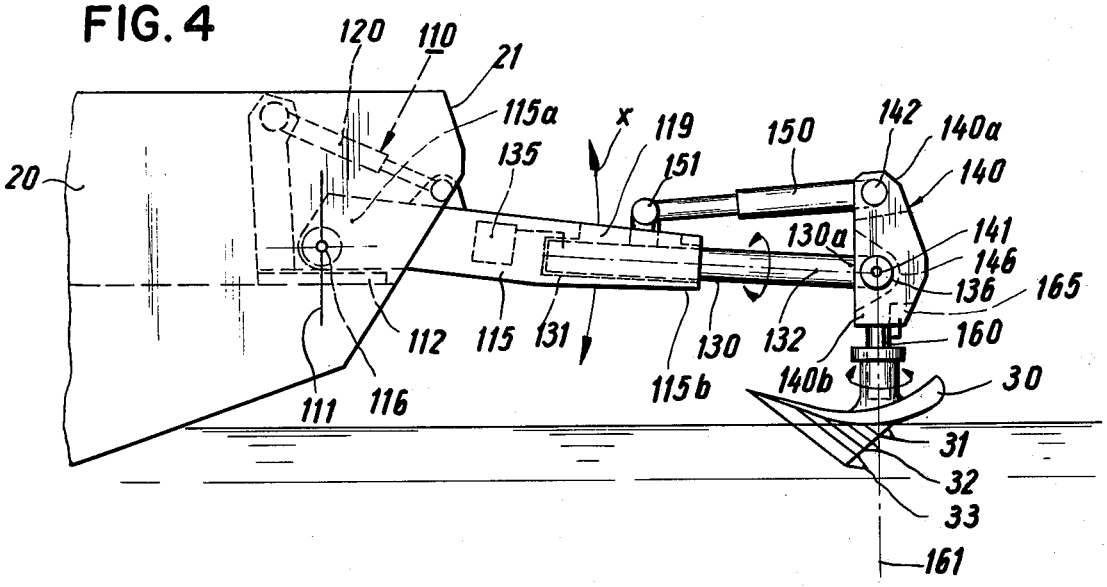
Figure 5:
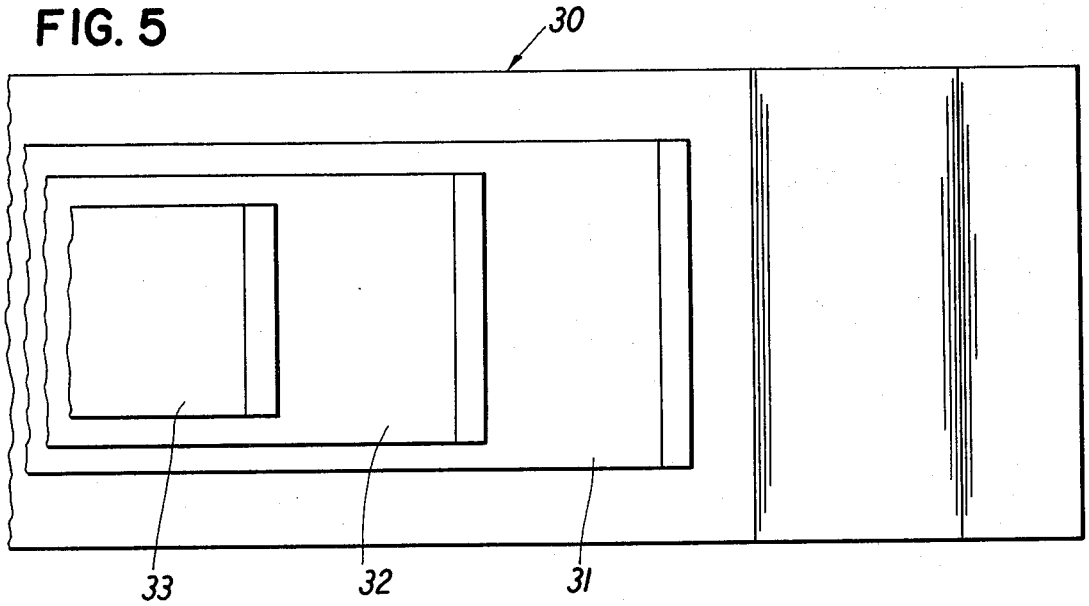

In the following, the present invention will be described with reference to the illustrative embodiments shown in the appended drawings wherein FIG. 1 is a schematical lateral elevational view of a cutting apparatus consisting of a sliding carriage carrying planing tools and adapted to be mounted on a ship's hull;

FIG. 2 is a lateral elevational view, partly shown in section and partly shown in elevation, of a cutting apparatus mounted at the forecastle of the ship's hull, in combination with means for rotating the cutting apparatus into the ship's hull;

FIG. 3 an elevational view, partly shown in section and partly shown in elevation, of the elastical mounting of the cutting apparatus at the forecastle of the ship's hull;

FIG. 4 is a schematical elevational view of another embodiment of the invention with an elastically suspended sliding carriage; and FIG. 5 is a schematic bottom view of the cutting apparatus shown in FIG. 1.

Referring to FIGS. 1–3, an ice sheet is indicated by the reference numeral 10, and a groove or channel cut into this ice sheet 10 is indicated by reference numeral 11.

As may be seen from FIGS. 1 and 2, the apparatus for cutting grooves into the ice sheet 10 includes a sliding carriage 30 mounted at the forecastle 21 of a ship's hull 20. The sliding carriage 30 is provided at its front end with a forwardly inclined deflector surface 36. The deflector surface 36 in inclined forwardly and upwardly. The sliding carriage 30 may be connected to the ship's hull 20 and carries in the embodiment shown in FIGS. 1–3 and 5 three planing tools 31, 32 and 33 that are coupled to the ship through the sliding carriage 30. In this manner, the propulsive energy is supplied directly by the ship's engine. The planing tools 31, 32 and 33 are arranged in a stacked, step-like arrangement and are of different lengths whereby the lengths of the planing tools decrease from the rearward planing tool 33 up to the forward planing tool 31 so that the cutting edges of the planing tools 31–33 are in different horizontal planes that are stepwise lower from the forward planing tool 31 to the rearward planing tool 33. The planing tools 31–33 are arranged in the sliding carriage 30 so that the longitudinal axis of each planing tool includes an acute angle with the machining direction, i.e. the surface of the ice sheet 10. The planing tools 31–33 are rigidly interconnected by means of a narrow vertical plate-shaped mounting 35. This connecting plate 35 is of a smaller width than the planing tools. The sliding carriage 30 is of a larger width than each of the planing tools 31–33 and the width of the planing tools decreases from the forward planing tool 31 to the rearward planing tool 33, note FIG. 5. The sliding carriage 30 may be rotated about a vertical axis indicated in FIG. 1 at 40. The vertical pivot axis 40 is in a vertical plane substantially coplanar with the center of gravity of the planing assembly, and this vertical plane is spaced forwardly of the cutting edge of the uppermost forward planing tool 31. A steering gear assembly 50 schematically shown in FIG. 2 serves to rotatably mount the pivot axis 40 and to connect this axis to the ship's body 20. The ice chips that will be formed when the planing tools 31–33 are advanced through the ice by the sliding carriage 30 in the direction of the arrow X are indicated at 13, 14 and 15 respectively. By means of the pivot axis 40, the sliding carriage 30 may be coupled to a vibrating device 41 known per se for generating small amplitude high frequency vertical vibrations.

For preventing any freezing fast of the ship especially when the ship does not move, and for reducing friction forces against the ice when the ship is travelling, the planing tools 31–33 may be provided interiorly with heat generating and/or heat transmitting devices not shown in the drawings. This generation of heat may be provided by resistance heating or by vapor or by hot water piped through the planing tools. Such heat generating devices may be provided in portions of the planing tools or may extend along the whole length of the planing tools 31–33. For increasing the depth of cut, the planing tools 31–33 may additionally be provided with supply and return lines for pressurized water that may be discharged at high speed at the bottom of one or several planing tools in the form of a high pressure jet that is directed predominantly downwardly or backwardly.

During periods of non-usage of the planing assembly consisting of the sliding carriage 30 and of the planing tools 31–33, the planing assembly may be withdrawn into the ship's hull 20, as may be seen from FIG. 2. Toward this end, the forecastle 21 of the ship's hull 20 is provided, within a portion adjacent to the planing assembly, with a recess 25. Thhis recess 25 is designed so as to likewise receive the vertical pivot axis 40 which defines a support column connecting the sliding carriage 30 through a steering gear assembly 50 with the ship's body. The steering gear assembly 50 may consist of a parallelogram type linkage including the steering rods 51 and 52. This linkage may be rotated by means not shown in the drawings so as to withdraw by a rotational movement the carriage 30 into the recess 25 of the ship's body 20. The fulcrums of the steering rods 51, 52 are indicated at 53, 54 and 55, 56 respectively. Retracting and extending of the carriage may also be achieved by means of hydraulic lifting cylinders or electric motors not shown, instead of employing a parallelogram type linkage. When suitably suspended, the steering gear assembly 50 mounts the carriage 30 so that the latter is yieldingly retained in all directions.

Another embodiment of the coupling between sliding carriage 30 and ship's body 20 is shown in FIG. 3. In this further embodiment, the sliding carriage 30 is suspended by means of cable assemblies 60, 62 and 61, 63 respectively. Every cable assembly consists of at least three cables in a star-shaped arrangement wiithin a horizontal plane. FIG. 3 merely shows two cables of each cable assembly. The cables 60, 62 are secured at one end at 64, 66 to the upper end **45*a* of the support rod 45 connected to the sliding carriage 30, whereas the free ends of the cables 61, 63 are secured at 65, 67 to the lower end 45*b* of the support rod 45. The cables 60 - 63 extend about guide rollers 70, 71, 72 and 73 respectively and are connected to motor driven capstan winches 80, 81, 82, 83** respectively.

Tensioning of every cable in each cable assembly is performed by the motors coupled to the respectivee winches. The drive means of the capstan winches 80–83 are coupled in common to a controller 100 which serves to control the tension of each cable so that the vertical elevation of the sliding carriage 30 with respect to the ice and the yielding characteristics of the carriage in any direction may be optimized.

As likewise shown in the embodiment of FIG. 3, the sliding carriage is towed by the ship. To this end, the sliding carriage 30 is connected by a tension cable 90 to a hydraulic cylinder 91, 92 mounted in the forecastle 21 of the ship's hull 20. The hydraulic cylinder 91, 92 may be withdrawn into the forecastle 21 when the sliding carriage is not being used.

The cutting apparatus operates briefly as follows: The ice sheet 10 is cut by the planing tools 31, 32 and 33. The forward planing tool 31 cuts a rectangular or trapezoidal-shaped groove into the ice and the ice chips 13 thus formed will be pushed upwardly. The profile of the planing tool 31 is suitably selected so as to allow to cut a rectangular or trapezoidal shaped groove into the ice. The same applies to the succeeding planing tools 31, 33 with respect to design and operation. With these planing tools, the ice chips will likewise be pushed upwardly. The cross-sectional clearances required for the removal of the ice chips are amply provided between the planing tools 31–33 and at the rear of the sliding carriage 30. For avoiding the development of excessive friction forces and the risk of jamming, the sliding carriage is preferably coupled to a vibrating device known per se such as the one schematically indicated in FIG. 1 at 40 and 41. A preferred vibrating device generates small amplitude high frequency vertical vibrations. The supply of heat energy or of pressurized water likewise serves to prevent the occurrence of high friction forces and eliminates the risk of jamming of ice chips. In addition to using vibrators or supplying heat energy to the planing tools 31–33, pressurized water may be employed for increasing the depth of cut. The pressurized water not only serves to aid in a faster removal of the ice chips but likewise serves to deepen the cut. Any desired combination of vibrators, heat energy supply devices and pressurized water supply devices may be employed.

When the ice sheet is irregular or includes obstacles the sliding carriage 30 together with the planing tools 31–33 performs deflecting movements due to its elastical suspension and because of the deflector surface 36 that is arranged at the front end of the carriage 30. The same applies in the case of laterally attacking forces.

During non-usage and for maintenance and servicing the sliding carriage 30 together with the planing tools may be withdrawn entirely into the recess 25 in the ship's hull 20, and the recess 25 may be covered by suitable covers (not shown).

The ship's hull of an icebreaker vessel may mount one or several sliding carriages 30 with corresponding planing tools 31–33, in accordance with the design and the operational requirements of the ship. Several cutting apparatus may be mounted side-by-side or along the center line of the ship's hull.

In the embodiment shown in FIG. 4, the cutting apparatus is elastically suspended from the ship. The ship's hull 20 includes a cantilever type forecastle 21 that extends above the ice. A rotary crane 110 is mounted on the forecastle 21 and includes a platform 112 rotatable about a vertical axis 111. The platform 112 mounts a bearing in which is journalled the free end 115*a* of a boom 115 about a horizontal axis 116. The other free end 115*b* of the boom 115 may be raised or lowered by rotation in the direction of the arrows *x*. Elevational rotations of the boom 115 are achieved by motive mechanisms 120 such as hydraulic cylinders or the like.

The boom 115 carries at its free end 115*b* a first supporting arm 130 that may be tubular and is journalled about its longitudinal axis 132 in a cylindrical guide indicated at 131. The cylindrical guide 131 is formed in the boom end 115*b*. If an additional restoring force is required for rotating the first supporting arm 130 about its longitudinal axis 132, then mechanical or hydraulic spring means (not shown) may be provided. Rotating of the first supporting arm 130 may also be achieved by means of motive mechanisms indicated at 135.

The first supporting arm 130 the longitudinal axis 132 of which is colinear with the longitudinal axis of the boom 115 carries at its free cantilever end 130*a* a crown piece 140 that may be rotated about a horizontal axis 141. The crown piece 140 is retained at the supporting arm end 130*a* in a swivel bearing defined by an arcuately or spherically shaped portion 136 of the first supporting arm 130 and a matingly shaped counterpart member 146 of the crown piece 140. The crown piece 140 thus defines a two-armed swivel lever having the lever end portions 140*a* and 140*b*. The upper crown piece lever end 140*a* is articulated at 142 to a hydraulic cylinder 150 having a piston rod that is connected at 151 to the inner portion of the first supporting arm 130 that is retained in the end 115*b* of the boom 115. A recess 119 in the wall of the boom 115 allows to mount the lifting cylinder 150 at the end of the supporting arm. This recess 119 is segment-shaped so as to avoid any interference with the rotational movements of the first supporting arm 130 by the lifting cylinder 150. The lever end portion 140*b* of the crown piece 140 facing the ice supports a second supporting arm 160 carrying at one end the sliding carriage 30 with the planing tools 31–33. The other end of the second supporting arm 160 is rotatably journalled in the crown piece 140 in a manner so that the second supporting arm 160 may be rotated about its vertical longitudinal axis 161. Rotating of the second supporting arm 160 may likewise be achieved by means of suitable motive mechanisms indicated at 165. If additional restoring forces are required for rotating the second supporting arm 160 back into its initial position, then mechanical or hydraulic spring means (not shown) may be provided.

The present invention is not restricted to the above described embodiments that are shown in the appended drawings. The scope of the present invention is intended to likewise encompass multi-sliding carriage arrangements. Two or three sliding carriages may be suspended from a corresponding number of booms from the forecastle.

What is claimed is:

1. An icebreaker vessel having a hull including a forecastle, marine propulsion means mounted in said hull, and means for breaking ice as the vessel travels along, said means for breaking ice comprising a slidable carriage mounted on the forecastle of said hull and having a forward end facing in the direction of travel of the vessel and rearward end spaced in a direction of travel rearwardly from the forward end, a plurality of planing tools secured to and projecting downwardly from said carriage and extending from said carriage in the direction of travel of the vessel so that said planing tools are disposed at an angle to said carriage, each of said planing tools having a cutting edge, said planing tools being spaced apart in the direction of travel of the vessel and defining therebetween cavities, the cutting edge of said planing tools arranged in a step-like manner with the downward dimension of the cutting edge of each said planing tool from said carriage increasing from said planing tool closest to the forward end of said carriage to said planing tool most remote from the forward end of said carriage, and said carriage having a deflector surface located in the direction of travel of the vessel ahead of said planing tool closest to the forward end of said carriage and spaced vertically upwardly from the cutting edge of said cutting tool closest to the forward end of said carriage, the deflector surface being arranged to rest on the top of the ice to be broken.

2. An icebreaker vessel according to claim 1, further comprising means for rotating and vertically adjusting said carriage so as to position said planing tools at a desired angle relative to the direction of travel of the vessel and to adjust the elevation of said planing tools.

3. An icebreaker vessel, as set forth in claim 2, wherein said means for rotating and vertically adjusting said carriage comprises a parallelogram type linkage, and said carriage comprises a pivot shaft extending upwardly from the top of said carriage toward the forecastle of said hull, said parallelogram type linkage having a first end connected to said pivot shaft and a second end connected to the forecastle.

4. An icebreaker vessel, as set forth in claim 1, wherein the cutting edges of said planing tools extend transversely of the direction of travel of the vessel and the length of the cutting edge on said planing tool closest to the forward end of said carriage is greater than the length of the cutting edge of said planing tool adjacent thereto and the length of the cutting edges of each of said planing tool decreasing in the direction opposite to the direction of travel of the vessel.

5. An icebreaker vessel, as set forth in claim 1, wherein a vertical plate extends between each of said planing tools in the direction of travel of the vessel and the dimension of said vertical plate transverse to the direction of travel of the vessel is less than the dimension of said planing tools measured in the same direction, said vertical plate extending through the cavity between adjacent said planing tools.

6. An icebreaker vessel as in claim 1 wherein the ship's hull is provided, in a region opposite the sliding carriage, with a recess, and the sliding carriage may be raised or rotated upwardly so as to be disposed within the recess.

7. An icebreaker vessel as in claim 1 wherein the sliding carriage may be towed by the forecastle by means of a cable, and is additionally connected to the ship by means of a vertical support rod extending into the ship's hull, the sliding carriage being further elastically suspended from the ship's hull by means of cable assemblies secured respectively to upper and lower end portions of the support rod, each cable assembly consisting of three cables in a planar star-shaped arrangement and adapted to be tensioned by means of motor-driven capstan winches.

8. An icebreaker vessel as in claim 7 wherein the capstan winches are coupled to control means for adjusting the elevational position and the orientation in space of the sliding carriage mounting the planing tools.

9. An icebreaker vessel as in claim 1 wherein the sliding carriage is mounted at the free cantilever end of a boom of a forecastle-mounted rotary crane and is coupled to the boom by a swivel means comprising three swivel axes extending at substantially right angles to each other.

10. An icebreaker vessel as in claim 9 wherein the swivel means includes a first supporting arm rotatably mounted about the longitudinal axis of the supporting arm, the first supporting arm being arranged at the free end of the boom and extending in a direction parallel to the boom; an arcuately shaped guide portion arranged at the free end of the boom; a crown piece arranged at the free end of the first supporting arm and adapted to be rotated about the arcuately shaped guide portion and about a horizontal swivel axis by a motive means; and a substantially vertical second supporting arm mounted on the crown piece and supporting the sliding carriage at a free lower end, the second supporting arm rotatably mounted about the vertical longitudinal axis of the supporting arm.

11. An icebreaker vessel as in claim 10 wherein motive mechanisms are provided for rotating the first supporting arm about the longitudinal arm axis, and for rotating the second supporting arm about the longitudinal axis of the second supporting arm.

12. An icebreaker vessel as in claim 11 wherein the end of the first supporting arm that is mounted and rotably journalled on the boom is coupled to the crown piece by means of a hydraulic cylinder, the crown piece is arranged in the form of a two-armed swivel lever, and the boom is provided with a recess disposed in the articulation region of hydraulic cylinder and first supporting arm, the recess being of a configuration and size so as not to interfere with rotational movements of the first supporting arm.

* * * * *